US008339228B2

(12) United States Patent
Ishizawa

(10) Patent No.: US 8,339,228 B2
(45) Date of Patent: Dec. 25, 2012

(54) EDGEWISE COIL AND INDUCTOR

(75) Inventor: Kazuki Ishizawa, Tokyo (JP)

(73) Assignee: TDK-Lambda Corporation, Chuo-Ku, Tokyo (JP)

( * ) Notice: Subject to any disclaimer, the term of this patent is extended or adjusted under 35 U.S.C. 154(b) by 66 days.

(21) Appl. No.: 13/005,183

(22) Filed: Jan. 12, 2011

(65) Prior Publication Data

US 2011/0273257 A1 Nov. 10, 2011

(30) Foreign Application Priority Data

Jan. 14, 2010 (JP) ..... 2010-006081

(51) Int. Cl.
*H01F 27/29* (2006.01)
*H01F 27/28* (2006.01)

(52) U.S. Cl. ..... 336/192; 336/222; 336/232

(58) Field of Classification Search ..... 336/192, 336/222, 225, 223, 232
See application file for complete search history.

(56) References Cited

U.S. PATENT DOCUMENTS

| | | | | |
|---|---|---|---|---|
| 3,262,026 | A * | 7/1966 | Rosner | 335/216 |
| 5,414,402 | A * | 5/1995 | Mandai et al. | 336/200 |
| 5,572,180 | A * | 11/1996 | Huang et al. | 336/200 |
| 6,028,500 | A * | 2/2000 | Buist | 336/100 |
| 6,369,684 | B1 * | 4/2002 | Iida et al. | 336/200 |
| 6,420,953 | B1 * | 7/2002 | Dadafshar | 336/200 |
| 6,504,463 | B1 * | 1/2003 | Kato et al. | 336/83 |
| 6,628,531 | B2 * | 9/2003 | Dadafshar | 361/836 |
| 7,986,208 | B2 * | 7/2011 | Yan et al. | 336/192 |
| 8,089,331 | B2 * | 1/2012 | Jacobson et al. | 336/84 C |
| 2009/0251272 | A1 * | 10/2009 | Satake et al. | 336/221 |
| 2010/0321143 | A1 * | 12/2010 | Satake et al. | 336/192 |

FOREIGN PATENT DOCUMENTS

| | | | |
|---|---|---|---|
| JP | 5-055048 | A | 3/1993 |
| JP | 9-232154 | A | 9/1997 |
| JP | 11-345721 | A | 12/1999 |
| JP | 2001-155932 | A | 6/2001 |
| JP | 2005-045119 | A | 2/2005 |
| JP | 2009-170804 | | 7/2009 |

OTHER PUBLICATIONS

Office Action (Notice of Reasons for Rejections) dated Nov. 9, 2011, issued in the corresponding Japanese Patent Application No. 2010-006081, and an English Translation of the Office Action.

* cited by examiner

*Primary Examiner* — Mohamad Musleh
*Assistant Examiner* — Joselito Baisa
(74) *Attorney, Agent, or Firm* — Buchanan Ingersoll & Rooney PC

(57) ABSTRACT

An edgewise coil achieves positioning of both end portions and accurate and reliable conduction with respect to a circuit board in a simple configuration, and can be downsized. The edgewise coil is usable in a conductor. The edgewise coil includes a base material and a coil member fixed at both end portions to the base material and including an external wound-wire portion placed on the base material and an internal wound-wire portion extending in the base material.

20 Claims, 7 Drawing Sheets

EDGEWISE COIL AND INDUCTOR

BACKGROUND OF THE INVENTION

1. Field of the Invention

The present invention relates to an edgewise coil and an inductor and, more specifically, to an edgewise coil which allows easy positioning of both end portions of a coil member and easy prevention of displacement, and an inductor having the edgewise coil.

2. Description of the Related Art

In the related art, an edgewise coil is used as a component of an inductor such as a choking coil. The edgewise coil generally used is a member formed by winding a rectangular wire having a cross section of a rectangular shape and wound into a helical shape so that a long side of the cross section extends in the radial direction. The edgewise coil can be formed into a flat shape by using the rectangular wire having a cross section of the rectangular shape, and is preferred in an environment which requires a low configuration. A choking coil using the edgewise coil and an inductance in the related art are disclosed in Patent Document 1.

The choking coil in the related art includes a cylindrical bobbin configured to support and fix the edgewise coil, an edgewise coil to be wound around an outer peripheral surface of the bobbin in a helical shape, and a set of upper and lower cores configured to hold the bobbin so as to interpose the same therebetween in the longitudinal direction thereof. There is a case where the respective components such as the bobbin and the edgewise coil are supplied from different manufactures to an assembly maker, and the assembly maker assembles the choking coil and packages the same to a power source substrate or the like.

PRIOR ART DOCUMENT

Patent Document

Patent Document 1: JP-A-2005-45119

SUMMARY OF THE INVENTION

Problems to be Solved by the Invention

When transporting the edgewise coil to the assembly maker, both end portions thereof are not fixed. Therefore, when the assembly maker assembles the edgewise coil to the bobbin or the core, and when the assembly maker packages the choking coil to the power source substrate or the like, the both end portions of the edgewise coil need to be positioned accurately to predetermined positions. Therefore, in the both steps of assembling the edgewise coil and packaging the choking coil, an operation to position the both end portions of the edgewise coil is necessary, and it is difficult to reduce the current operating time in the structure of the edgewise coil in the related art. Since the rectangular wire of the edgewise coil is flat, the demand for a low configuration may not be satisfied because the edgewise coil is assembled obliquely with respect to the core or the choking coil to which the edgewise coil is assembled is inclined by itself.

In association with downsizing of electronic components, the thickness of the edgewise coil is extremely thin. When the edgewise coil in this configuration is transported without being fixed at both end portions thereof, there are probabilities of breakage or cutting of a coil portion of the edgewise coil or bending of the both end portions which are free to move due to vibrations, impacts, or the like. When the coil portions of the edgewise coils are inclined due to the vibrations, the impacts, or the like applied during transport, there arises a probability of a failure of sufficient electric connection of the both end portions with respect to a circuit board or the like, which is to be performed after the transport.

It is also conceivable to position the both end portions of the edgewise coil using the bobbin as in the case of the choking coil in the related art, the choking coil is upsized by an extent corresponding to the dimensions of the bobbin, and hence it is difficult to satisfy the demand of low configuration and downsizing of the choking coil as a result.

In view of such circumstances, it is an object of the invention to provide an edgewise coil which achieves positioning of both end portions and accurate and reliable conduction with respect to a circuit board in a simple configuration, and can be downsized, and an inductor having the edgewise coil.

Means for Solving the Problem

In order to solve the above-described problem, there is provided an edgewise coil including a base material, and a coil member having an external wound-wire portion fixed at both end portions thereof to the base material placed on the base material and an internal wound-wire portion extending in the interior of the base material.

Preferably, one end portion of the external wound-wire portion and one end portion of the internal wound-wire portion are fixed to the base material, and the other end portion of the external wound-wire portion is electrically connected to the other end portion of the internal wound-wire portion.

Preferably, the external wound-wire portion and the internal wound-wire portion are electrically connected in series.

Preferably, the other end portion of the external wound-wire portion and the other end portion of the internal wound-wire portion are connected via a conducting area provided on the base material.

Preferably, a winding axis of the external wound-wire portion and a winding axis of the internal wound-wire portion are concentric.

Preferably, the one end portion of the external wound-wire portion is connected to a positioning depression on the base material via an insulating member, and the one end portion of the external wound-wire portion and the one end portion of the internal wound-wire portion are arranged on the side of the same surface of the base material.

Preferably, the coil member is formed of a rectangular wire, and a long side surface of the external wound-wire portion is fixed to the base material with an adhesive agent.

Preferably, the winding diameter of the external wound-wire portion and the winding diameter of the internal wound-wire portion are the same.

In order to solve the above-described problem, there is provided an inductor including the edgewise coil having one of configurations described above and a core configured to hold the edgewise coil so as to interpose the same.

Preferably, the core has a shape to expose both end portions of the coil member to the outside of the core.

Technical Advantages of the Invention

According to the invention, since the edgewise coil is configured in such a manner that the part of the coil member is extended in the base material and the both end portions of the coil member are fixed to the base material, and the inductor is provided with the edgewise coil in this configuration, it is not necessary to perform the positioning of the both end portions again when assembling the both end portions to electric components in a post-process, and the both end portions can be connected to the circuit board accurately and reliably. In particular, since the both end portions of the edgewise coil are fixed to the base material, even when the vibrations or the impacts are applied to the edgewise coil and the inductor provided with the edgewise coil, displacement of the positions of the both end portions are avoided, so that the occurrence of the unnecessary positioning work is prevented.

The bobbin which is necessary in the inductor in the related art is not necessary, and the low configuration and downsizing of the inductor is realized.

DESCRIPTION OF PREFERRED EMBODIMENT

[Configuration of Inductor]

Figure 1A:
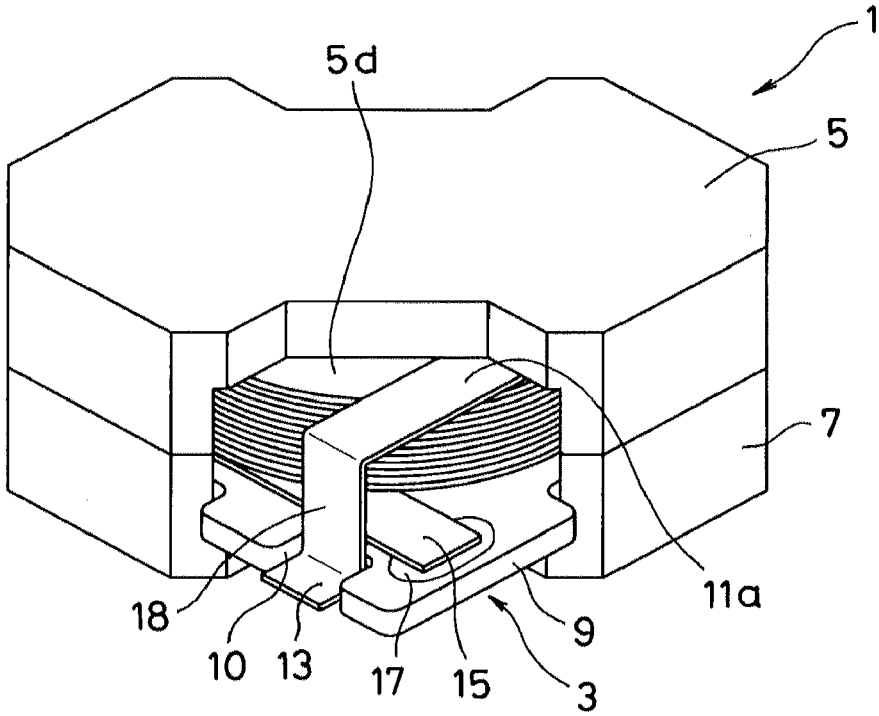
FIG. 1A is a perspective view showing an appearance of an inductor according to an embodiment of the invention.
Figure 1B:
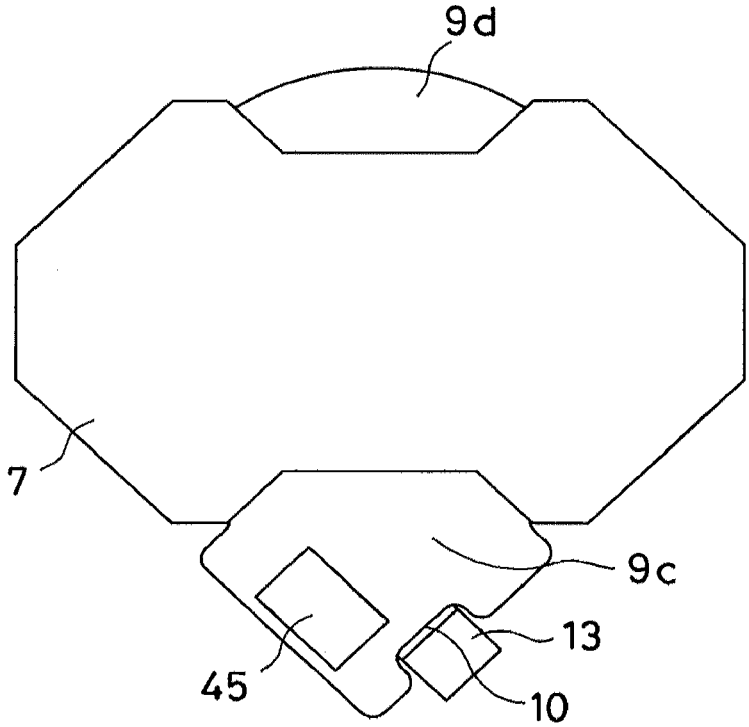
FIG. 1B is a bottom view of FIG. 1A.
Figure 2:
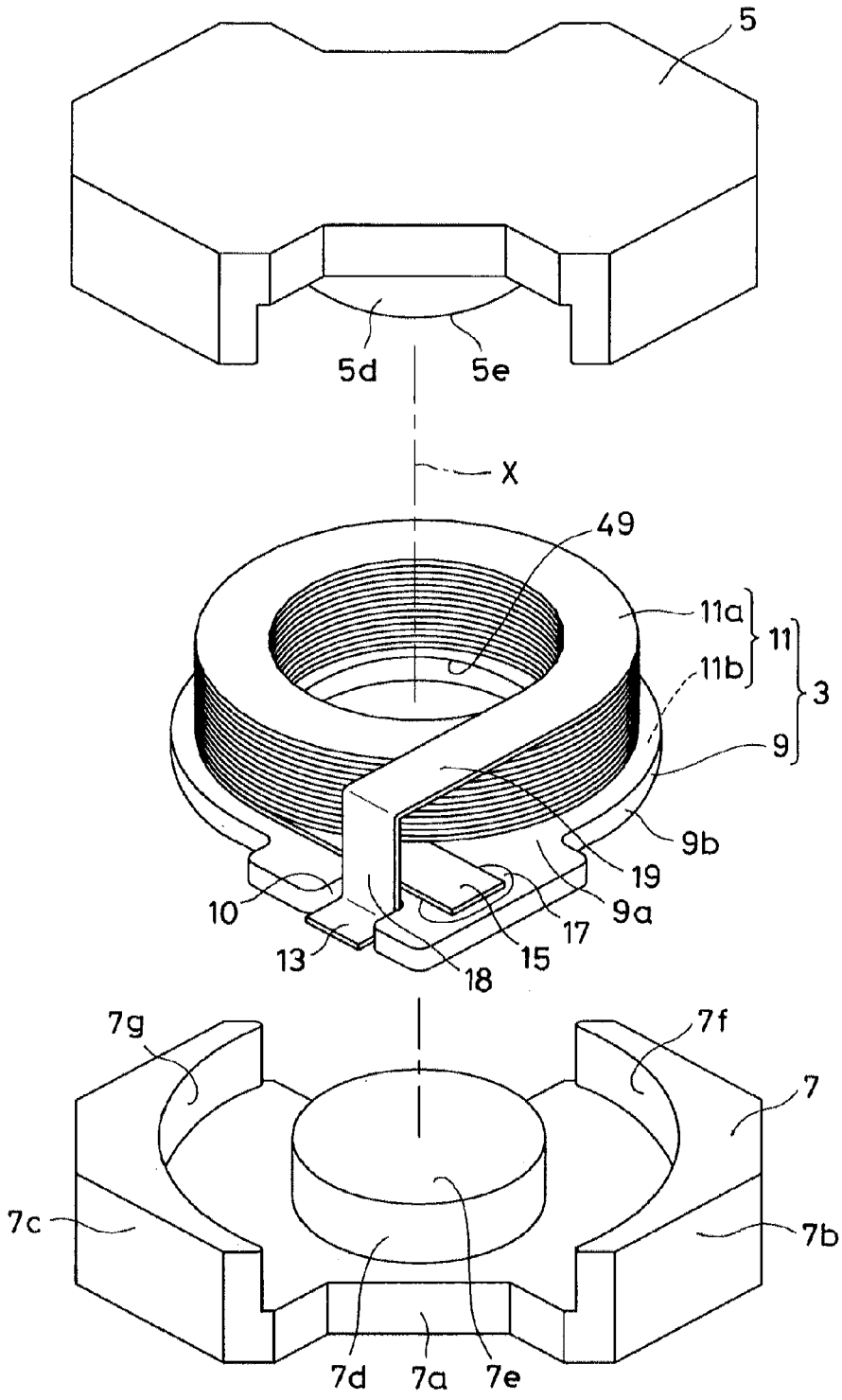
FIG. 2 is an exploded view of the inductor in FIG. 1.
Figure 3A:
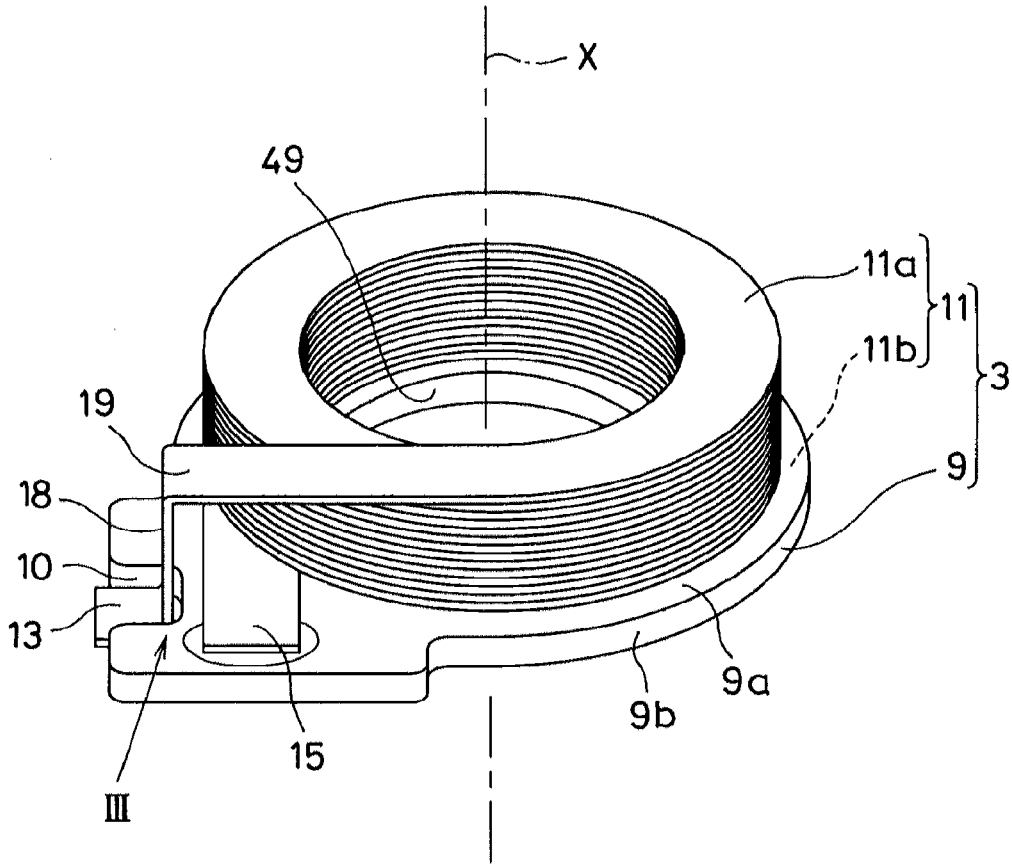
FIG. 3A is a perspective view of an edgewise coil in FIG. 2.
Figure 3B:
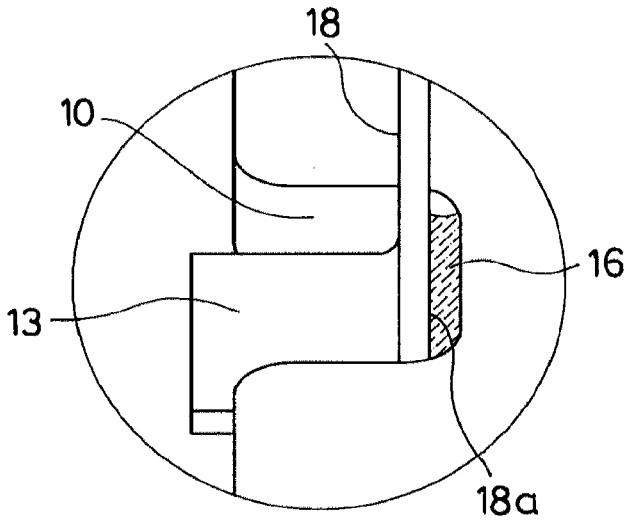
FIG. 3B is an enlarged view viewed in the direction indicated by an arrow III in FIG. 3A.
Figure 4:
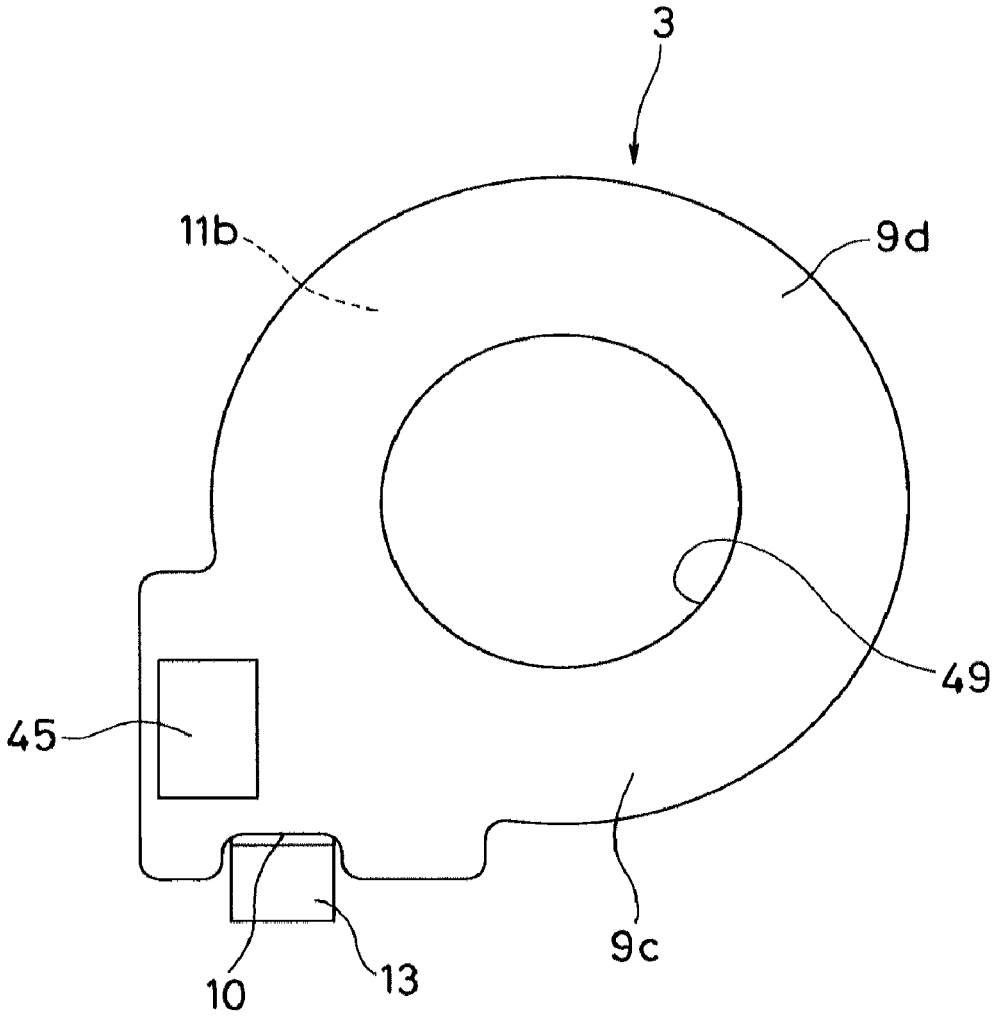
FIG. 4 is a back view of the edgewise coil in FIG. 2.

Referring now to FIG. 1 to FIG. 6, an inductor 1 to which an edgewise coil 3 according to an embodiment of the invention is applied will be described. FIG. 1A is a perspective view showing an appearance of the inductor 1 according to the embodiment of the invention, FIG. 1B is a bottom view of FIG. 1A, FIG. 2 is an exploded view of the inductor 1 in FIG. 1; FIG. 3A is a perspective view showing the edgewise coil 3 in FIG. 2, FIG. 3B is an enlarged view viewed in the direction indicated by an arrow III in FIG. 3A, and FIG. 4 is a back view of the edgewise coil 3 in FIG. 2. For clarifying the drawings, electrical insulating adhesive agent 16 shown in FIG. 3B is omitted from FIG. 3A.

As shown in FIG. 1 and FIG. 2, the inductor 1 includes the edgewise coil 3, an upper core 5, and a lower core 7. The edgewise coil 3 is held between the upper core 5 and the lower core 7 in the direction of a winding axis X about which a coil member 11 of the edgewise coil 3 is wound.

As shown in FIG. 3A, the edgewise coil 3 includes a laminated substrate 9 as a base material and the coil member 11 to be fixed at both end portions 13 and 15 (see FIG. 3A) to the laminated substrate 9. The coil member 11 includes an external wound-wire portion 11*a* to be placed on the laminated substrate 9 and an internal wound-wire portion 11*b* extending in the interior of the laminated substrate 9. In other words, the internal wound-wire portion 11*b* is stored in the interior of the laminated substrate 9. The external wound-wire portion 11*a* is formed of a copper-made rectangular wire having a cross section in a rectangular (oblong) shape. The coil member 11 is wound in a helical shape so that short sides of the rectangular wire form an inner diameter surface and an outer diameter surface, and long sides extend radially about the winding axis X.

A back surface of a leading end portion 15 of the external wound-wire portion 11*a* which constitutes the coil member 11 is electrically connected to the an upper end portion (see FIG. 6) of the internal wound-wire portion 11*b* in the laminated substrate 9 by a soldering member 17. The rectangular wire which constitutes the external wound-wire portion 11*a* is wound from the leading end portion 15 fixed to the laminated substrate 9 upward in FIG. 2 and FIG. 3. An uppermost layer wound portion 19 of the external wound-wire portion 11*a* extends substantially parallel to the laminated substrate 9, continues to a vertical portion 18 extending so as to approach the laminated substrate 9 in the vertical direction with respect to the laminated substrate 9, and further continues to the terminal portion 13 extending in parallel to the laminated substrate 9.

As shown in FIG. 3B, a back surface 18*a* of the vertical portion 18 of the external wound-wire portion 11*a* is fixed to a positioning depression 10, which is a notch of an edge portion of the laminated substrate 9, with a fixing device such as the electrical insulating adhesive agent 16 or the like which achieves electric insulation. Therefore, the terminal portion 13 is fixed by being bonded to the positioning depression 10, so that displacement after having bonded is prevented.

[Configuration of Laminated Substrate]

Figure 5:
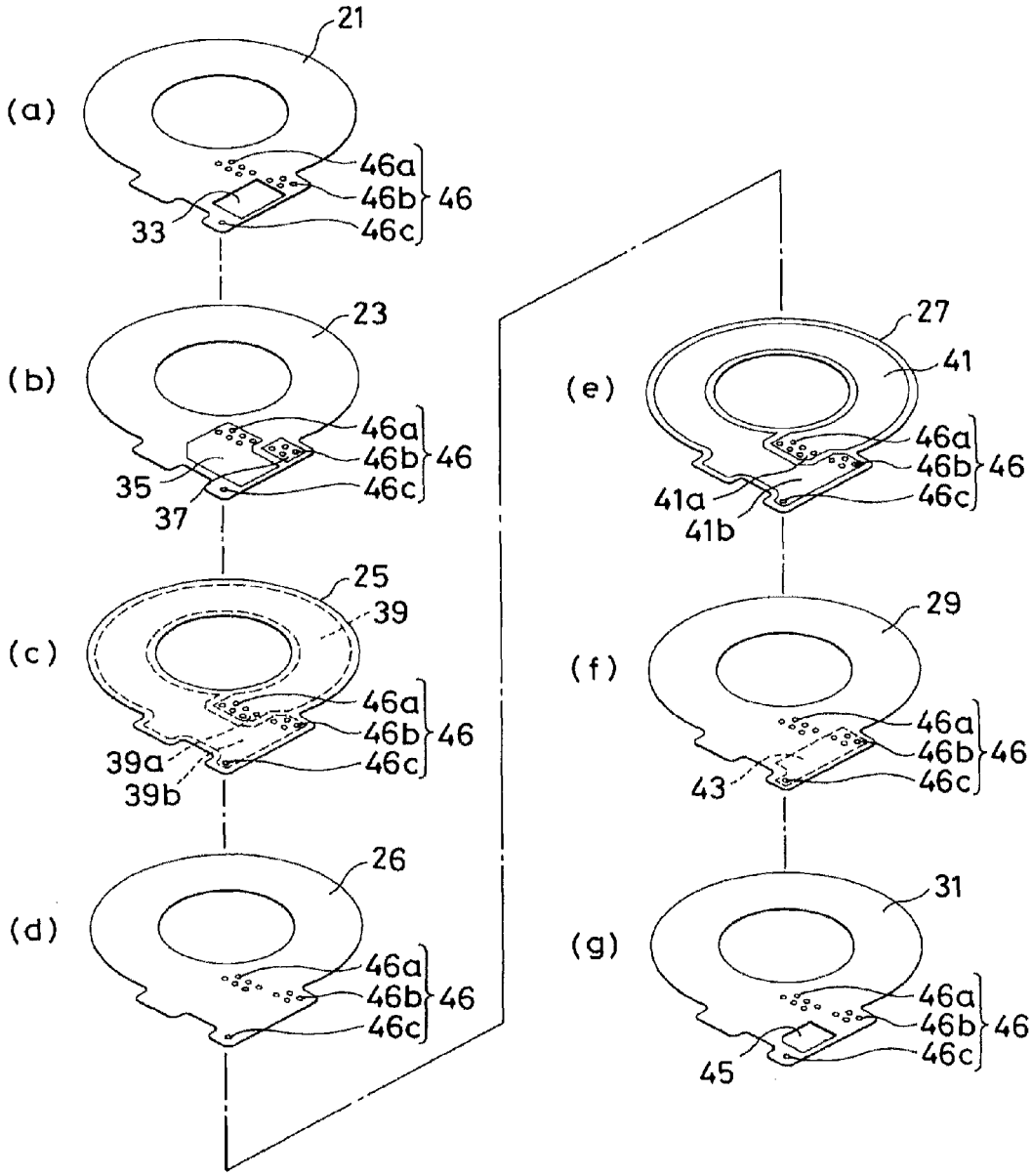
FIG. 5 is a perspective view showing a laminating state of a laminated substrate which constitutes the edgewise coil in FIG. 2.
Figure 6:
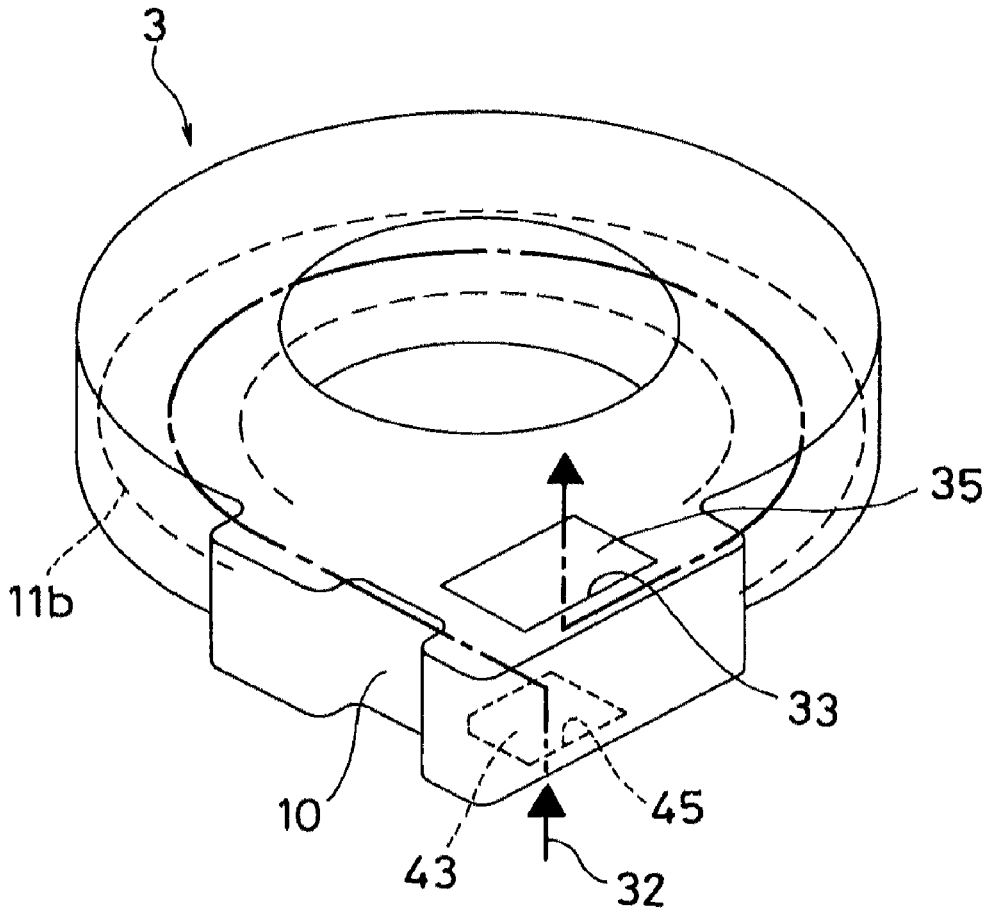
FIG. 6 is a perspective view conceptually showing a route of conduction in the laminated substrate in FIG. 5.

The internal wound-wire portion 11*b* in this embodiment is a copper foil pattern formed in the interior of the laminated substrate 9. Referring now to FIG. 5 and FIG. 6, the laminated substrate 9 is mainly described. FIG. 5 is a perspective view showing a laminating state of the laminated substrate 9 which constitutes the edgewise coil in FIG. 2, and FIG. 6 is a perspective view conceptually showing a route of conduction in the interior of the laminated substrate 9 in FIG. 5. The first to seventh substrate members 21 to 31 shown in FIG. 5 are each formed of a substantially annular thin member, and form the internal wound-wire portion 11*b* by being laminated and bonded in this sequence.

The first substrate member 21, which is the uppermost layer of the laminated substrate 9, constitutes a front surface 9*a* of the laminated substrate 9, and is a thin film of a resist layer to be applied to (coated on) an upper surface of the second substrate member 23, described later. The first substrate member 21 is formed with a through port 33 penetrating therethrough in the thickness direction. The leading end portion 15 of the external wound-wire portion 11*a* is connected to a conducting area 35 of the second substrate member 23, described later, by the soldering member 17 or the like via the rectangular through port 33 (the conducting area 35 is exposed) (see FIG. 1 to FIG. 3). Formed underside of the first substrate member 21 is the second substrate member 23. The second substrate member 23 includes a pripreg layer made up of a sheet formed by impregnating woven fabric or the like with semi-cured thermosetting resin in advance and a copper foil pattern formed of copper foil on a front surface which comes into contact with the first substrate member 21 of the pripreg layer. The copper foil pattern includes the substantially L-shaped conducting area 35 and a substantially rectangular shaped conducting area 37. The copper foil pattern is applied with metal plating.

Formed underside of the second substrate member 23 is the third substrate member 25. The third substrate member 25 includes a pripreg layer and a conducting area 39 as a substantially C-shaped copper foil pattern extending along a peripheral edge of the third substrate member 25 on a back surface opposing a front surface of the pripreg layer with which the second substrate member 23 comes into contact. When the second and third substrate members 23 and 25 are laminated, one end portion 39*a* of the substantially C-shaped conducting area 39 is brought into conduction with the substantially L-shaped conducting area 35 of the second substrate member 23 via through holes 46*a* described later.

Formed underside of the third substrate member 25 is the fourth substrate member 26, which is a core substrate layer.

Formed underside of the fourth substrate member 26 is the fifth substrate member 27. The fifth substrate member 27 includes a pripreg layer and the conducting area 39 which is a copper foil pattern formed on a front surface with which the fourth substrate member 26 of the pripreg layer comes into contact in the same manner as the third substrate member 25. A substantially C-shaped conducting area 41 has the same dimensions and the same shape (configuration) as the conducting area 39 of the third substrate member 25.

Laminated underside of the fifth substrate member 27 is the sixth substrate member 29. The sixth substrate member 29 includes a pripreg layer and a copper foil pattern formed of copper foil on a back surface opposing a front surface which comes into contact with the fifth substrate member 27 of the pripreg layer. The copper foil pattern is formed of a substantially rectangular shaped conducting area 43. The copper foil pattern is applied with metal plating.

Laminated underside of the sixth substrate member 29 is the seventh substrate member 31. The seventh substrate member 31 constitutes a back surface 9*c* of the laminated substrate 9 and is a thin film of a resist layer which constitutes the lowermost layer of the laminated substrate 9 to be applied to (coated on) a lower surface of the sixth substrate member 29. The seventh substrate member 31 is formed with a substantially rectangular through port 45 penetrating therethrough in the thickness direction thereof as in the case of the first substrate member 21 as the uppermost layer. The rectangular shaped conducting area 43 of the sixth substrate member 29 can be brought into conduction with a conducting pad 55 of a power source substrate 51, described later, via the through port 45. Therefore, the conducting area 43 constitutes one end portion of the coil member 11 in this embodiment.

Furthermore, the first to seventh substrate members 21 to 31 described above are formed with a plurality of through holes 46 (46*a*, 46*b* and 46*c*) having the same dimensions, the same shapes, and penetrating at the same positions in the direction of thickness after having formed the respective conducting areas 35 to 43 described above, and are applied with metal plating. Therefore, the laminated substrate 9 is configured to be brought into conduction between predetermined conducting areas on the substrate members via the through holes 46.

For example, the substantially L-shaped conducting area 35 of the second substrate member 23 is brought into conduction respectively with one end portions 39*a* and 41*a* of the conducting areas 39 and 41 of the third and fifth substrate members 25 and 27 via the through holes 46*a*. The other end portions 39*b* and 41*b* of the conducting areas 39 and 41 of the third and fifth substrate members 25 and 27 are brought into conduction with the substantially rectangular shaped conducting area 37 of the second substrate member 23 and the substantially rectangular shaped conducting area 43 of the sixth substrate member 29 via the through holes 46*b* and 46*c*.

The first to seventh substrate members 21 to 31 are configured not to be brought into conduction with each other except for the through holes 46. Therefore, as shown in FIG. 6, the internal wound-wire portion 11*b* as a conducting route (shown by an alternate long and short dash line) 32 which allows passage of electric current is formed in the interiors of the first to seventh substrate members 21 to 31 (the laminated substrate 9).

In this embodiment, as described above, the conducting pattern in the substantially C-shaped conducting areas 39 and 41 of the third and fifth substrate members 25 and 27 are connected in parallel. However, the invention is not specifically limited thereto. In other words, the shape, the number of turns, dimensions, the winding direction, and the like of the internal wound-wire portion may be changed as needed according to a desired inductance capacitance. In this embodiment, the inductance capacitance of the internal wound-wire portion is set to be equivalent to the inductance capacitance corresponding to one turn of the external wound-wire portion.

[Configuration of Core]

The edgewise coil 3 in the configuration as described above is held by the upper core 5 and the lower core 7 having the same dimensions and the same shapes as shown in FIG. 1 and FIG. 2. Therefore, description will be made only about the lower core 7. In plan view, the lower core 7 includes a base portion 7*a* having a shape like a gourd, a column-shaped supporting portion 7*d* projecting at a substantially center portion of the base portion 7*a* along the direction of the winding axis X, and projecting portions 7*b* and 7*c* swelling from both end portions of the base portion 7*a* in the same direction as the supporting portion 7*d*.

The outer diameter of the supporting portion 7*d* is determined to be slightly smaller than the diameter of an inner peripheral surface 49 of the laminated substrate 9. Therefore, when the laminated substrate 9 is mounted on lower core 7 so that the supporting portion 7*d* is positioned in the opening of the laminated substrate 9, positioning of the lower core 7 with respect to the laminated substrate 9 is achieved. Curved surfaces 7*f* and 7*g* of the projecting portions 7*b* and 7*c* and an outer peripheral surface 9*b* of an arcuate shaped portion of the laminated substrate 9 are determined to have substantially the same radius of curvature, thereby assembleability of the laminated substrate 9 to the lower core 7 is improved.

The lower core 7 and the upper core 5 have such a dimensional relationship that an abutting surface 7*e* at a distal end portion of the supporting portion 7*d* of the lower core 7 opposes an abutting surface 5*e* of a supporting portion 5*d* of the upper core 5 while holding the edgewise coil 3 between the upper core 5 and the lower core 7 when the supporting portion 7*d* of the lower core 7 and the supporting portion 5*d* of the upper core 5 are opposed and abutted against each other.

As shown in FIG. 4, an end portion of the edgewise coil 3 on one side is the conducting area 43 of the internal wound-wire portion 11*b* (an end portion of the coil member 11) exposed from the through port 45 of the back surface 9*c* of the laminated substrate 9, and the other end portion of the edgewise coil 3 is an end portion of coil member 11 extending on the same plane as the back surface 9*c*, that is, the terminal portion 13 of the external wound-wire portion 11*a*. In other words, the both end portions of the edgewise coil 3 are arranged on the side of the same plane of the laminated substrate.

[Method of Mounting on Power Source Substrate of Inductor]

Figure 7:
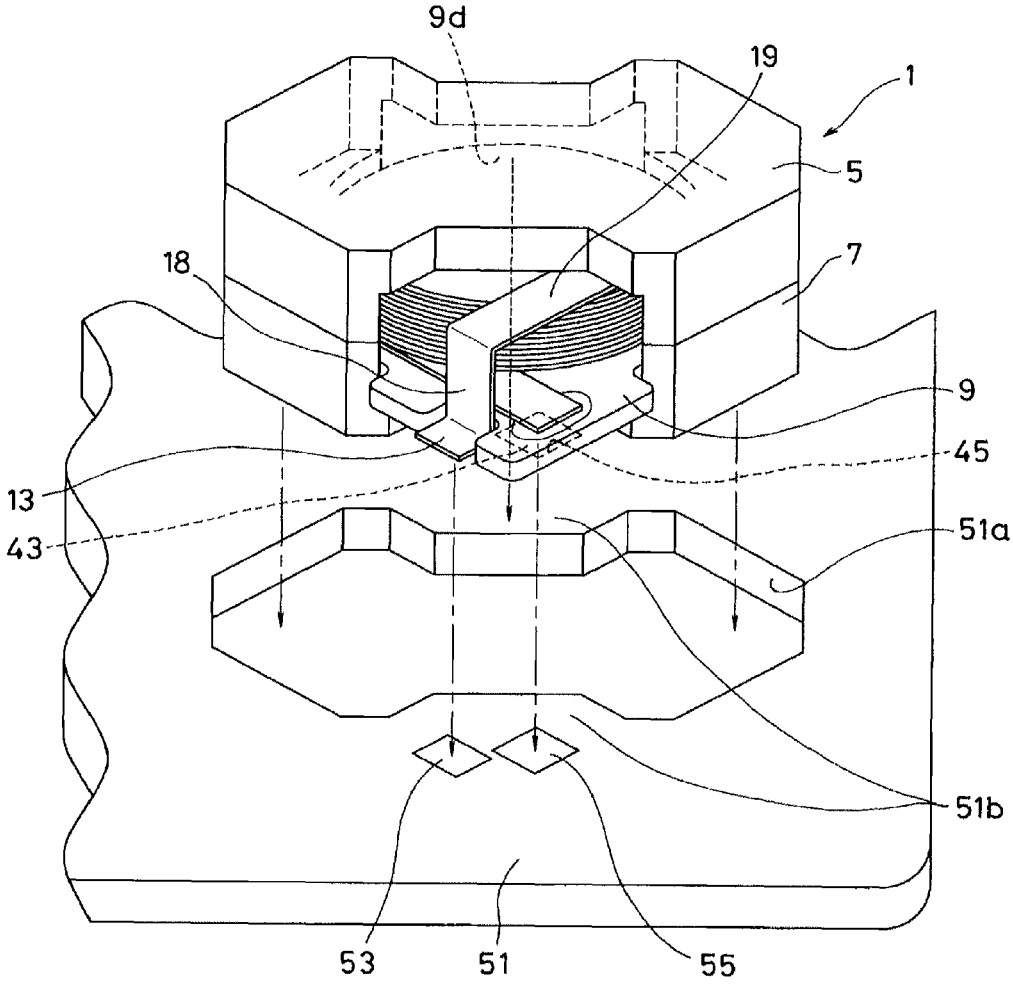
FIG. 7 is a perspective view showing a method of mounting the inductor in FIG. 1 to a power source substrate.

Referring now to FIGS. 1, 2, 4, and 7, a step of packaging the inductor 1 on the power source substrate 51 will be described. FIG. 7 is a perspective view showing a method of packaging the inductor 1 in FIG. 1 on the power source substrate 51.

The power source substrate 51 on which the inductor 1 is packaged is a panel-shaped member formed with a conducting pattern, not shown, on a front surface thereof. The power source substrate 51 is formed with a through hole 51*a* penetrating in the direction of the thickness, and the through hole 51*a* has a complementary shape with the outer shape of the base portion 7*a* of the lower core 7 in plan view. When the lower core 7 is inserted into the through hole 51*a*, a packaging supporting portion 9*d* of the back surface 9*c* of the laminated substrate 9 exposed to the outside from the upper core 5 and the lower core 7 (see FIG. 1B and FIG. 7) comes into abutment with a pair of projecting portions 51*b* extending to narrow the width of the through hole 51*a*.

Two rectangular conducting pads 53 and 55 are arranged apart from each other in the vicinity of one of the projecting portions 51*b* of the power source substrate 51. The conducting pads 53 and 55 are electrically connected to the conducting pattern, not shown. When the inductor 1 is inserted into the through hole 51*a*, and the packaging supporting portion 9*d* comes into abutment with the projecting portion 51*b*, the conducting pads 53 and 55 come into contact with the both end portions of the edgewise coil 3 (the conducting area 43 and the terminal portion 13). Mounting of the inductor 1 configured as described above is completed when the packaging supporting portion 9*d* is fixed to the projecting portion 51*b* with an adhesive agent or the like, the terminal portion 13 of the external wound-wire portion 11*a* is soldered to the conducting pad 53, and the conducting area 43 of the internal wound-wire portion 11*b* is soldered to the conducting pad 55.

As described above, since the both end portions (the conducting area 43 and the terminal portion 13) of the coil member 11 of the edgewise coil 3 are fixed to the laminated substrate 9, even when the inductor 1 having the edgewise coil 3 assembled therein is packaged on the circuit board such as the power source substrate 51, the both end portions of the edgewise coil 3 can be brought into conduction with the conducting pattern of the circuit board only by positioning the base material as the laminated substrate 9 of the edgewise coil 3 with respect to the circuit board. Therefore, a complicated operation in the related art such as to position the both end portions of the edgewise coil 3 in the packaging step is no longer necessary. It is needless to say that the position of the both end portions of the edgewise coil 3 can be changed to given positions on the laminated substrate according to the shape of the circuit board on which the inductor is packaged.

In addition, even when vibrations or impacts are applied to the edgewise coil 3 by itself or to the inductor 1, since the both end portions 13 and 15 of the edgewise coil 3 are fixed to the laminated substrate 9, positions of the both end portions 13 and 15 are not displaced, and hence occurrence of unnecessary positioning work is prevented.

In this embodiment, the back surface (the long side surface) of the wound portion on the lowermost layer, which comes into contact with the laminated substrate 9 of the external wound-wire portion 11*a*, is fixed to the laminated substrate 9 with the adhesive agent to improve the shape retaining property with respect to the vibrations or the impacts applied on the external wound-wire portion 11*a*. In this embodiment, the external wound-wire portion 11*a* is a coil member having a structure in which adjacent long side surfaces come into contact with each other and wound in the helical shape. Therefore, the low configuration of the edgewise coil and the inductor having the edgewise coil assembled thereto is improved.

In this embodiment, the external wound-wire portion 11*a* is placed on the laminated substrate 9 which supports the internal wound-wire portion. However, the invention is not limited to this configuration. For example, a configuration in which the external wound-wire portions are placed on the front surface and the back surface of the base material is also applicable. Various modes can be selected as long as the edgewise coil has at least the internal wound-wire portion extending internally of the base material and the external wound-wire portion extending externally of the base material.

Although the winding diameter of the external wound-wire portion 11*a* and the internal wound-wire portion 11*b* are set to be the same in this embodiment, the invention is not limited to this configuration, and may be modified as needed. Although the edgewise coil 3 in this embodiment has such a configuration that the winding axis X thereof extends vertically to the laminated substrate 9, the invention is not limited thereto, and may be modified as needed. Although the laminated substrate 9 formed by laminating a plurality of laminated substrate members is used as the base material, a base material having a single layer or a base material having a curved shape or a shape having projection and depression according to the shape of the inductance to which the edgewise coil is assembled can be used as the base material.

The invention may be embodied in various modes without departing the essential characteristics. Therefore, it is needless to say that the above-described embodiment is given for the purpose of explanation only, and is not intended to limit the invention.

REFERENCE NUMERAL

1 inductor
3 edgewise coil
5 upper, core
7 lower core
9 laminated substrate
10 positioning depression
11 coil member
11*a* external wound-wire portion
11*b* internal wound-wire portion
13,15 terminal portion
16 electrical insulating adhesive agent
17 soldering member
18 vertical portion
18*a* back surface
19 uppermost layer wound portion
21~31 substrate member
32 conducting route
33,45 through port
35~43 conducting area
46 through hole
51 power source substrate
53,55 conducting pad

What is claimed is:

1. An edgewise coil comprising:

a base substrate having an internal winding therein; and a coil member formed of a rectangular wire and placed on the base substrate, wherein a first terminal of the internal winding is formed in a to surface of the base substrate, a second terminal of the internal winding is formed in a bottom surface of the base substrate, the base substrate having a positioning portion, which is a notch, formed in an edge of the base substrate, a first end portion of the coil member is electrically connected with the first terminal, a second end portion of the coil member is set in the positioning portion, and wherein a surface of the second end portion and the bottom surface of the base substrate are substantially located in the same plane, and the second end portion of the coil member is fixed to the base substrate at the positioning portion, and wherein the second terminal and the second end portion are utilized as external terminals.

2. The edgewise coil according to claim 1, wherein the coil member and the internal winding are electrically connected in series.

3. The edgewise coil according to claim 2, wherein the first end portion of the coil member and the first terminal of the internal winding are connected via a conducting area provided on the base substrate.

4. The edgewise coil according to claim 1, wherein the first end portion of the coil member and the first terminal of the internal winding are connected via a conducting area provided on the base substrate.

5. An inductor comprising:

an edgewise coil according to claim 4; and a core configured to hold the edgewise coil so as to interpose the same.

6. The edgewise coil according to claim 1, wherein a winding axis of the coil member and a winding axis of the internal winding are concentric.

7. An inductor comprising:

an edgewise coil according to claim 6; and a core configured to hold the edgewise coil so as to interpose the same.

8. The edgewise coil according to claim 1, wherein the first end portion of the coil member is fixed to the base substrate with an adhesive agent.

9. The edgewise coil according to claim 1, wherein a winding diameter of the coil member and a winding diameter of the internal winding are the same.

10. An inductor comprising:

an edgewise coil according to claim 1; and a core configured to hold the edgewise coil so as to interpose the same.

11. The inductor according to claim 10, wherein the core has a shape to expose the first and second end portions of the coil member to the outside of the core.

12. An edgewise coil comprising:

a base substrate having an internal winding therein, the internal winding having a first terminal formed in a top surface of the base substrate and a second terminal formed in a bottom surface of the base substrate, and wherein the base substrate has a positioning portion, which is a notch, formed in an edge of the base substrate; and a coil member placed on the base substrate, wherein a first end portion of the coil member is electrically connected with the first terminal and a second end portion of the coil member is set in the positioning portion, and wherein a surface of the second end portion and the bottom surface of the base substrate are substantially located in the same plane, and the second end portion of the coil member is fixed to the base substrate at the positioning portion.

13. The edgewise coil according to claim 12, wherein the coil member is formed of a rectangular wire.

14. The edgewise coil according to claim 12, wherein the second terminal and the second end portion are utilized as external terminals.

15. The edgewise coil according to claim 12, wherein the coil member and the internal winding are electrically connected in series.

16. The edgewise coil according to claim 12, wherein the first end portion of the coil member and the first terminal of the internal winding are connected by a conducting area provided on the base substrate.

17. The edgewise coil according to claim 12, wherein a winding axis of the coil member and a winding axis of the internal winding are concentric.

18. The edgewise coil according to claim 12, wherein a winding diameter of the coil member and a winding diameter of the internal winding are the same.

19. An inductor comprising:

an edgewise coil comprising:

a base substrate having an internal winding therein; and a coil member formed of a rectangular wire and placed on the base substrate, wherein a first terminal of the internal winding is formed in a top surface of the base substrate, a second terminal of the internal winding is formed in a bottom surface of the base substrate, the base substrate having a positioning portion, which is a notch, formed in an edge of the base substrate, a first end portion of the coil member is electrically connected with the first terminal, a second end portion of the coil member is set in the positioning portion, and wherein a surface of the second end portion and the bottom surface of the base substrate are substantially located in the same plane, and the second end portion of the coil member is fixed to the base substrate at the positioning portion, and wherein the second terminal and the second end portion are utilized as external terminals; and an upper core and a lower core, and wherein the edgewise coil is held between the upper core and the lower core in a direction of a winding axis about which the coil member is wound.

20. The inductor according to claim 19, wherein the first and the second end portions of the coil member are outside of the core.

* * * * *